United States Patent [19]

Martindell

[11] Patent Number: 4,880,122

[45] Date of Patent: Nov. 14, 1989

[54] STORAGE AND DISPLAY APPARATUS FOR POWER BITS

[76] Inventor: J. Richard Martindell, 9605 Village Green N.E., Albuquerque, N. Mex. 87111

[21] Appl. No.: 248,536

[22] Filed: Sep. 23, 1988

[51] Int. Cl.[4] ..... A47F 7/00

[52] U.S. Cl. ..... 211/70.6; 211/4; 211/69; 206/377; 206/374; 206/560

[58] Field of Search ..... 211/70.6, 4, 69, 60.1, 211/1.5; 206/379, 377, 376, 375, 374, 373, 372, 560

[56] References Cited

U.S. PATENT DOCUMENTS 2,414,942 1/1947 Glazer ..... 211/60.1 X 3,400,812 9/1968 Show ..... 211/4 X

*Primary Examiner*—Blair M. Johnson

[57] ABSTRACT

Storage and display apparatus for permitting discretionary securing and releasing power shank tools. The apparatus is comprised of a rack assembly having three parallel shelves. The upper two having aligned holes to locate and restrain the tools against radial movement. The uninterrupted lower shelf constrains the tools against axial movement in the insertion direction. Rack ends, perpendicular to the shelves, are provided with holes through which a D cross section rod, free to rotate, is inserted. The D rod is located relative to the tool shank, and is of such a diameter that, when rotated so that the flat surface is parallel to the tool axis, the tools can be inserted and withdrawn. When rotated to an angle to the tool axis, the circumferential portion of the rod engages the groove surface preventing tool removal.

8 Claims, 2 Drawing Sheets

STORAGE AND DISPLAY APPARATUS FOR POWER BITS

BACKGROUND OF THE INVENTION

1. Field of the Invention:

This invention relates to power bits, more particularly to a method for storing and displaying same, and also a method for accessing same.

2. Description of Prior Art:

The term "power bit" refers to elements typically used for driving fastener devices, such as screws, nuts and bolts. The most commonly used power bits generally have a hexagonally configured shank and a groove extending about the shank with a flat portion disposed at the bottom of the groove between two radiused portions. Such power bits have been used since at least 1930 and their use has increased substantially in recent years.

The American National Standards Institute has a specification for such tools known as ANSI B 107.4. The standard refers to driving and spindle ends for power bits for portable hand, air and electric tools. These power bits were initially developed for portable hand operated power tools having chucks with hexagonal bores to receive and transmit torque to the bits. The non-slip positive retention of the polygonal mating bit shank and chuck bore was deemed necessary because of the relative high torque required for driving threaded fasteners. The common three jaw key chuck, used primarily with round shank tools, such as drills, has a torque limiting characteristic in that slippage occurs when the driving torque exceeds the largely frictional holding force of the jaws.

In addition to the positive torque transmission of the hexagon shank, the annular groove in the power bit shank provides high restraining forces against axial pull out forces when used in conjunction with a detenting feature, such as a ball or pin with restrained radial movement, found in most power chucks with hexagonal bores. Examples of chucks are found in Decker U.S. Pat. No. 1,642,490 and Lafferty SR, U.S. Pat. No. 3,726,533. Although power bits are frequently used in three jaw key chucks, the quick release feature of the groove and detent is not available so that the key must be used for bit insertion and removal. While the three jaw key chuck is common on nearly all hand power drills, quick release chucks, having hexagonal bores and detenting features, have been developed to replace the three jaw chucks on the power tool spindle, or to be used in conjunction with the three jaw key chuck. An example of the latter is shown in the inventor's U.S. Pat. No. 4,692,973.

With the rapidly increasing use of power screw drivers, using the hexagonal bore power chuck, and increased use of high torque variable speed hand power drills, both line and battery powered; and with the introduction of quick release chucks for these drills, the use of power tools with the ANSI hex shank configuration is growing exponentially. Further impetus for this expansion is being generated by the recent introduction of twist drills incorporating this power shank. While methods for storing and displaying round shank drills have become commonplace, the same cannot be said for power bits and tools incorporating the referenced ANSI hexagon power shank.

The most common method for storing round shank tools, such as drills and reamers, is what is referred to as a bit box or a bit index. These generally take two forms.

For the industrial market this takes the form of a metal box, with hinged compartments, referred to as inserts or panels. These contain rows of differing size holes corresponding to the tool or drill diameter to be mounted therein. The compartments or inserts are generally formed of sheet metal and have two rows of corresponding holes to hold the tools in unidirectional alignment to each other. Because of the differing lengths of the drills or tools, usually bearing a proportional relationship to the diameter, the box is tapered to constrain the tools from coming out of their mounting holes in the hinged compartments when the bits are in the down or constrained position parallel to the box bottom when the lid of the box is closed. If the box is not tapered to accomplish this, then fences, known as stops, are attached to the bottom of the box. They are either diagonal, stepped, or individual to restrain the tool of a corresponding length.

In this type of box, the drills or tools are removed when the tools are rotated upward about the hinge, away from the bottom of the box, and when the end of the drill bit or tool clears the restraining fence feature. A variation of this type of box has the box hinged so that the portion of the box, having the tapered end or the tool constraining fences, can be rotated away from the tools allowing them to clear the fencing feature, thus permitting removal of the drills or tools. A commonality of these boxes is the requirement for individually sized holes and a fencing feature when the tools are in the rotated down position parallel to the box bottom, in a position for the box lid closure.

For the consumer market the round shank drills or tools are generally stored and packaged in a molded plastic box, usually with two rows of plastic detents molded into the bottom, or both the bottom and top of the hinged box. As with the metal bit boxes described, the molded in detents are individually sized for the diameter of the tool to be constrained. An advantage for this type of bit box is that the fence type constraints of the metal type box are not required, although the boxes are frequently tapered on one end to conform to the graduated bit lengths. A disadvantage of this box is that the detent features holding the drills wear with frequent use, at some point failing to restrain the tool. The frequent or industrial user will generally prefer the metal box, electing to replace the bits rather than the box.

Since both type boxes are normally opaque, the display features of the tools within is minimal. If the tools are packaged for display purposes, the method is generally to skin or blister pack the carded tools, offering minimal storage utility as the packaging is normally discarded.

Although both the above type of boxes have been used for packaging and storage of the hexagon power shank bits and tools, the limitations noted above still exist. A modification of the above method of packaging and storing the power shank bits and tools is a circular or tubular plastic box with hole or tubular compartments arrayed around and parallel to the central axis of the box. Originally designed for drill bits, the tubular compartments were molded to various internal diameters and lengths to accommodate the varying drill bits. The bits were constrained by either a removable plastic cap or an axially restrained cap with a single opening which could be dialed to the desired tool.

Both of the above type of plastic boxes are inherently limited to a narrow range of bit diameters and lengths although adapted to accommodate hexagon shank power bits. Because of the high cost of injection mold tooling, these boxes are generally made for a specific set of tools similar in function and of a limited range of sizes; the demand for which can justify the high initial tooling costs. The same, to a lesser degree, applies to the common metal bit index boxes.

Because of the limitations cited above, for currently available means to store and display the wide range of bits and tools incorporating the hexagon power shank, a need currently exits for a more versatile and more economical way to store and display these tools. It is this need that the present invention addresses.

The apparatus of the present invention, using the unique features of the hexagon power shank, offers a new and useful means for constraining these tools for both storage and display.

SUMMARY OF THE INVENTION

The invention described and claimed herein is a mechanical means whereby the annular groove in a hexagonal tool shank, as specified and defined in ANSI B 107.4, is used in conjunction with a rod having a "D" shaped cross section to; in one relative rotational position, lock the power bits into a constrained relationship within a rack holding such tools; while in another rotational position, release the power shank tool for removal from said rack. The rack of this invention is a mechanical structure having a cross section of an approximate "E" configuration. The relative angular position of the rod to the rack being caused by rotation of the rack about the rod for storage purposes, and the rod within the rack for display purposes.

Among the objects of this invention are the following:

To provide a new and useful apparatus for retaining power shank tools in a fixed position within an enclosure for storage purposes, and easy removal of these from that position when the enclosure is opened for access to the tools;

To provide a new and useful apparatus for openly displaying these tools, in an orderly array in a horizontal row or rows, on a display surface or board, with a means of retaining the tools against unintended removal, and a means to allow simple intended removal by the actuation of a rotational lever or by camming action caused by depressing a linear actuation button;

To provide a new and useful apparatus, for both storage an display of these tools, having a high degree of versatility, overcoming the constraints imposed on conventional methods by size and length variations of the tools.

DESCRIPTION OF PREFERRED EMBODIMENTS

Figure 1:
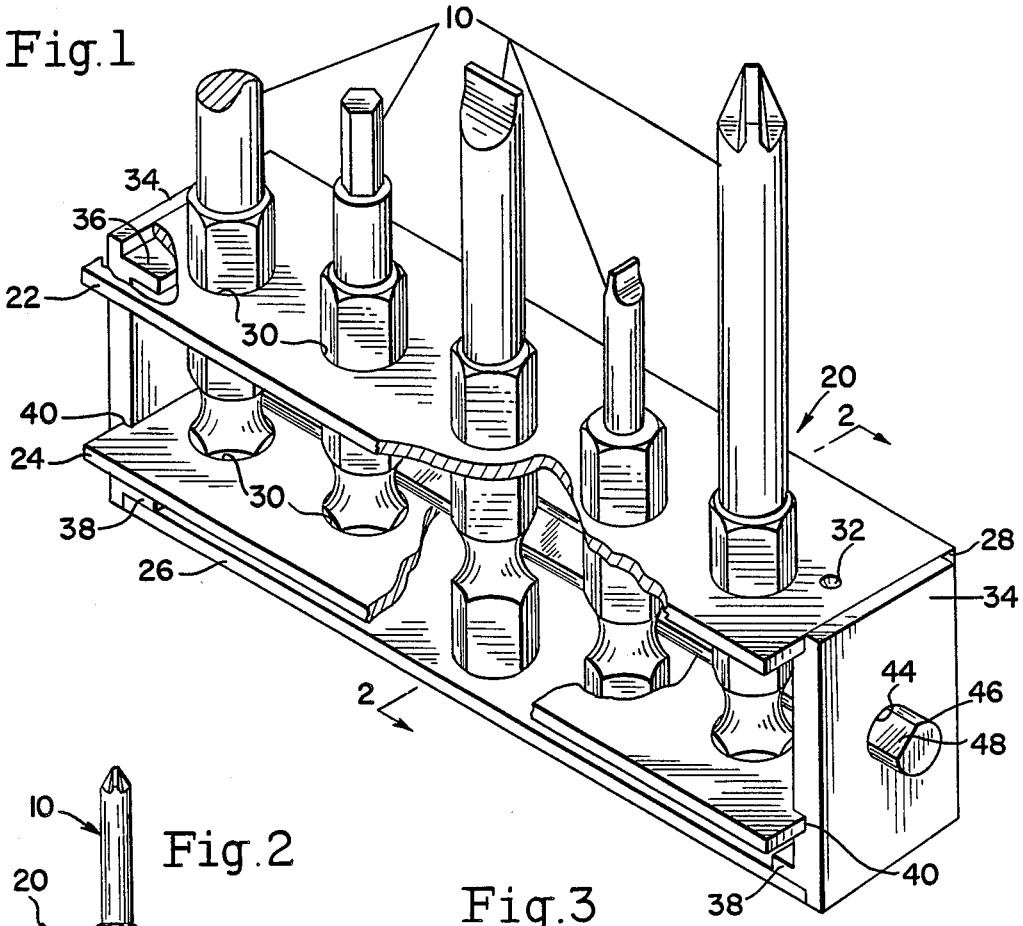
FIG. 1 is a perspective view in partial break away showing the essential elements, in assembly, common to both the storage and display embodiments of the invention.

There are two distinct but closely related species of the apparatus of this invention. Preferred embodiments of both are described in the following.

The first is defined in FIGS. 1 through 6 and is the storage embodiment of the apparatus.

The second is defined in FIGS. 7 through 11 and is the display embodiment of the apparatus.

The terms "storage" and "display", while generally describing the usage of the two types or species of the apparatus, are used to distinguish the functional difference of the two for purposes of description; whereas in actual utilization, depending on the application of the invention, the terms might be used interchangeably as will be noted in the further description.

Major elements of the storage and display embodiments are common to both and will be described first and numbered the same on the drawing to obviate the need for redundant and repetitious description.

Referring now to the drawings:

FIG. 1 is a perspective view showing the essential elements, in assembly, common to both the storage and display embodiments of the invention. An array of power shank tools 10 is shown located in fixed position therein. Although the number of distinct tools applicable to be positioned thusly numbers in the hundreds, for illustration purposes, five are shown to illustrate the versatility and utility of the invention. Not shown, but equally applicable, are power shank tools such as bit holders, finder bits, awls, lagscrew drivers, and twist drills. Each type is available in many lengths and sizes.

Common elements of both embodiments are:

A rack (20), of one piece construction, generally of an "E" cross section, the length of which will vary depending on the number of tools to be stored or displayed. The width or extension of the top leg 22 and the middle leg 24 is the same. The width of the bottom leg 26 is less for functional reasons to be explained. The three legs are referred to as shelves in the appended claims. The spine 28 of the "E" section, perpendicular to the three legs, has a length slightly shorter than the hexagon shank of the power tools in the array 10.

A row of holes 30, the number depending on the number of tools to be stored or displayed, is disposed in the top leg 22 and middle leg 24. The rows are parallel in the length direction. The individual holes are in vertical alignment with, and coaxial with, a corresponding hole in the other leg. The spacing of the hole pairs is normally equal, but may vary if required. The holes 30 can be either round as shown, of such diameter to just allow clearance with the diagonal corners of the tools; or hexagonal allowing minimal clearance with corresponding surfaces of the tool shank.

The bottom leg 26 of the rack 20 has an uninterrupted surface providing a shelf for arresting the bottom of the tool shanks against further movement in their axial direction when inserted into the holes 30.

In the construction shown, a detent 32 is provided at both ends of the top leg 22 and the bottom leg 26 of the rack 20. The detents provide engagement and retention with rack ends 34.

The rack ends 34 are of a configuration to engage the rack 20 at both ends having in cross section an upper 36 and lower 38 shelf to engage with and locate on the top 22 and bottom 26 legs of rack 20. A notch 40 is located at a position to engagingly receive the middle leg 24 of the rack 20 in assembly.

Figure 4:
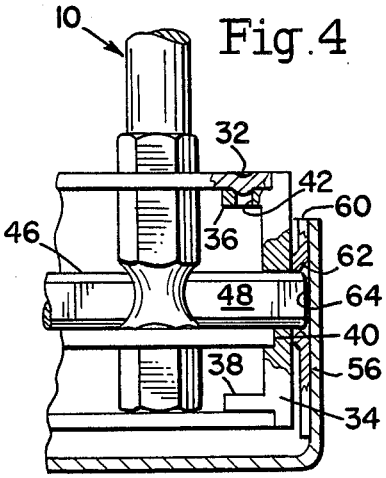
FIG. 4 is a front elevation view, partially in break away, showing details of the method of assembly in the box shown in section.
Figure 5:
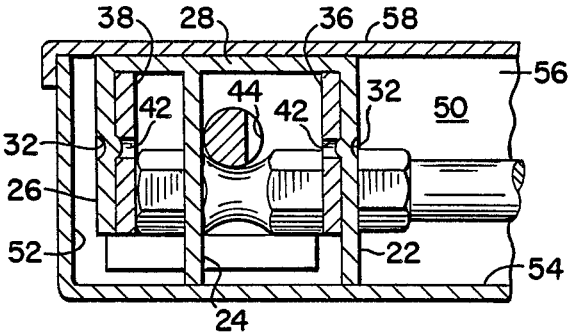
FIG. 5 is an enlarged sectioned view of the left end of FIG. 3 showing greater detail.

A hole 42 shown in FIGS. 4 and 5 is disposed in the upper 36 and lower 38 shelf of rack ends 34 to receive the detents 32 in the rack 20 securing the rack ends 34 thereto.

A hole 44 is disposed through the rack ends 34 in a fixed functional relationship to the axis of the holes 30 in rack 20, and to the axial location and dimensions of the annular groove in the power shank of the tools as specified in ANSI B 107.4, when inserted through the holes 30 of the rack 20 and in engagement with leg 26; this functional relationship is described below. The diameter of holes 44 also bears a functional relationship to the specified groove dimension which will be described below.

In assembly with rack 20, the holes 44 in the rack ends 34 are aligned to receive a "D" rod 46. The diameter of the rod 46 and the chord length, which establishes the straight flat surface 48 thereon, are also related to and are functions of the hex power shank annular groove specified in ANSI B 107.4. The length of the "D" rod 46 is determined by the number of pairs of holes 30 and hole spacing in rack 20.

Figure 10:
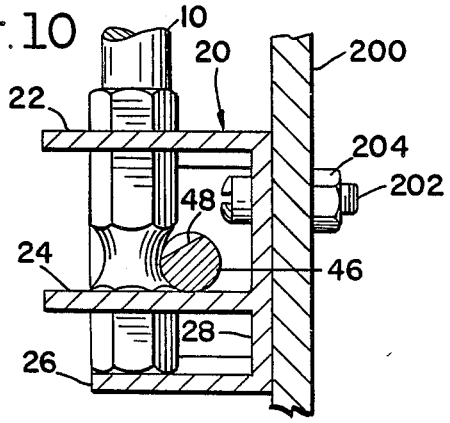
FIG. 10 is a sectioned end elevation view, taken generally along line 10—10 of FIG. 7, showing the "D" rod in the tool restrain position.
Figure 11:
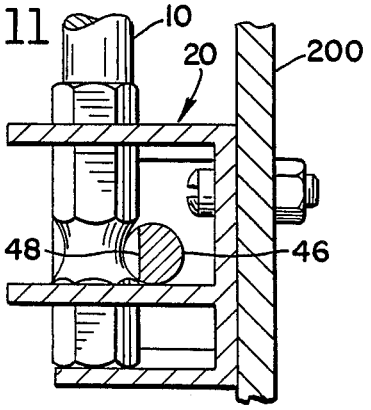
FIG. 11 is a sectioned end elevation view, taken generally along line 11—11 of FIG. 9, showing the "D" rod in the tool release/insert position.

The functional relationship between the location of holes 30 in the rack 20, the location and diameter of holes 44 in the rack ends 34, and the diameter and chord length of the flat surface 48 of rod 46 is described as follows:

The diameter of the rod 46 is the same as, or very close to, twice the radii of the annular groove of the hex power shank specified in ANSI B 107.4. For the $\frac{1}{4}$ inch hex power shank this would be nominally 3/16 inch. Referring to FIGS. 10 and 11, the distance of the rod 46 axis from the axis of the power tool shank is $\frac{1}{2}$ the shank internal groove diameter plus $\frac{1}{2}$ the rod 46 diameter plus a small clearance between the rod 46 and the radiused groove surfaces to allow sliding contact when relative rotation about the rod 46 axis occurs. For tools with a $\frac{1}{2}$ inch hexagon shank this distance is 3/16 inch plus clearance.

In functional relationship, the axis of the rod 46 coincides with the center point of the arc establishing the lower or rearmost radius of the tool shank groove. The distance of this rod 46 axis from the bottom of the tool shank, and thusly the top surface of rack 20 bottom leg 26 is a distance specified in ANSI B 107.4. For the $\frac{1}{4}$ inch hexagon shank, this distance is nominally $\frac{3}{8}$. This functional relationship between the leg 26 and the rod 46 axis determines the location of the top surface of middle leg 24, the function of which, in conjunction with the holes 30 therein, is to maintain the tools in alignment. To maximize tool stability, this distance is chosen to be the distance of the rod 46 axis from the top surface of bottom leg 26 minus $\frac{1}{2}$ the diameter of rod 46, less a small clearance between the rod 46 and the leg 24. For $\frac{1}{4}$ hexagon tools, this distance is nominally 9/32 inch less clearance.

Figure 2:
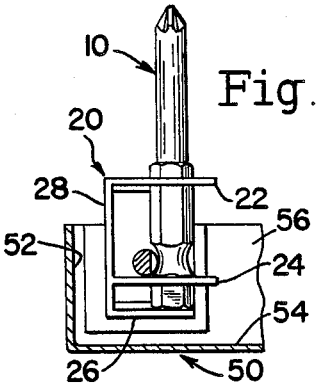
FIG. 2 is a sectioned elevation view, taken generally along the line 2—2 of FIG. 1, showing the assembly of FIG. 1, mounted in a box shown partially in section, with the hexagon shank tool in vertical, insertion/retraction position.

The diameter of the holes 44 in the rack ends 34 is nominally the same diameter as the rod 46 plus minimal clearance to allow free rotation of the rod 46 in the holes 44. The cross section chord length, which establishes the width of the flat surface 48 of "D" rod 46, is determined by functional consideration such that when flat surface 48 is parallel to the axis of the tools as shown in FIGS. 2, 4 and 11, the flat surface 48 will just clear the circumferential diagonal extremities of the power shank as it is withdrawn in an axial direction from the rack 20. The chord height is determined to be $\frac{1}{2}$ the diagonal distance across the hexagon shank corners minus $\frac{1}{2}$ the internal groove diameter. For a $\frac{1}{4}$ inch hexagon shank, this is nominally 0.0506 inch giving a nominal chord width of 0.1664 inch.

Figure 3:
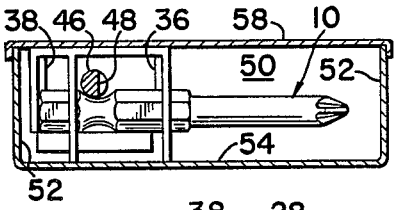
FIG. 3 is a sectioned elevation view, taken generally along the line 2—2 of FIG. 1, showing the assembly of FIG. 1 mounted in a box, shown in section, with the hexagon shank tool in the horizontal constrained position, with the box lid in place.
Figure 7:
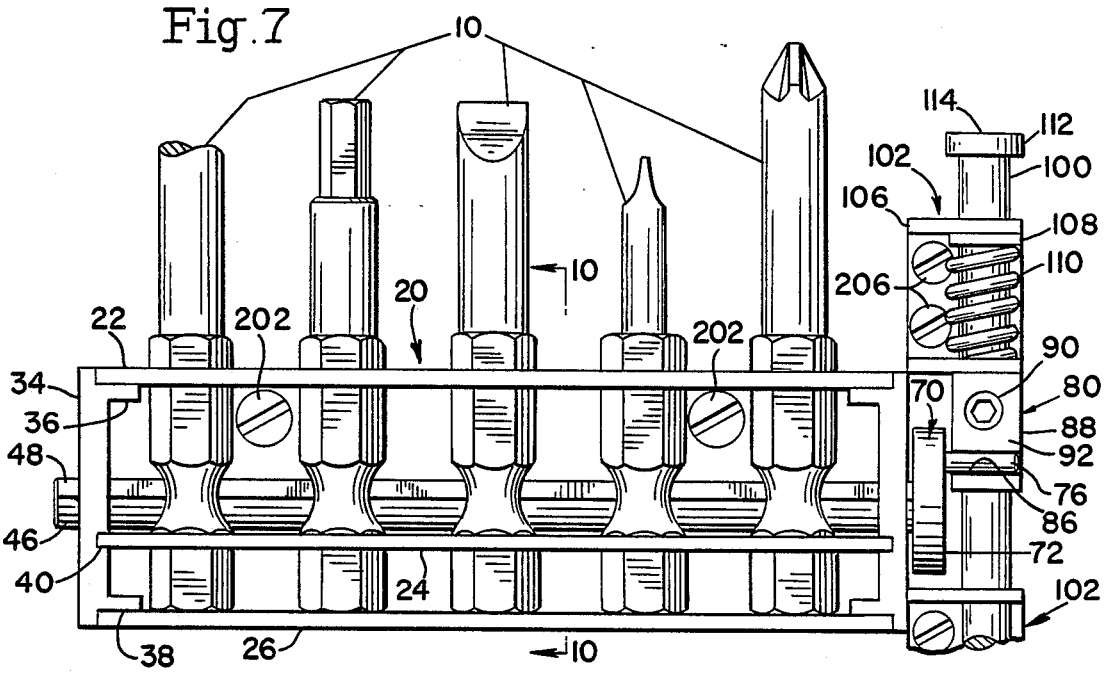
FIG. 7 is a plan view of the assembly of FIG. 1 mounted to a flat display surface with the restrain/-release mechanism assembled with and mounted thereto.

From the above it is seen that the assembly of rack 20, rack ends 34 and "D" rod 46 will provide the following in conjunction with power shank tools. When the flat surface 48 of "D" rod 46 is parallel to the axis of the coaxial holes 30 in legs 22 and 24 of rack 20, a power shank tool can be freely inserted and withdrawn from said holes. A corollary function is seen when the flat surface 48 of the "D" rod 46 is at an angle to the axis of the coaxial holes 30 in legs 22 and 24 of rack 20. Referring to FIGS. 3, 7 and 10, if this condition exists, it is seen that an interference is created between the circumferential surface of the "D" rod 46 and the rearmost radiused surface of the annular groove in the power shank; so that while the flat surface 48 of the "D" rod 46 remains in the aforesaid angular position, the tool cannot be withdrawn if inserted as shown in the referenced figures or can it be fully inserted if having been withdrawn as described above.

The result then is that with the "D" rod 46 in one relative angular position to the axis of the tools, they are locked against removal; and in another relative angular position of the "D" rod 46 to the axis of the tools, they can be inserted and removed. This relative relationship as well as the structural features described above are common to both embodiments described herein.

The structural members, the rack 20 and the rack ends 34, described above and shown in the drawings, are of constant cross section and are therefore suited to be made from an extrusion process. Aluminum extrusions are preferred for these members, offering the best compromise between tooling costs, material cost, and strength and wear characteristics. Plastic, either extruded or molded, could be used at a sacrifice of strength and wear resistance. Rolled steel shapes could be used at a sacrifice of high tooling cost. The holes 30 in the rack 20 and 44 in the rack ends 34 can be punched or drilled. The use of extrusions gives a high degree of flexibility in that the rack 20 can be cut to any length compatible with the number of tools to be stored or displayed therein. The three piece assembly of rack 20 and rack ends 34 could be replaced by a one piece construction of formed sheet metal or by plastic injection molding, both at a great sacrifice in flexibility and high tooling costs. The preferred construction of the "D" rod 46 is of steel drawn to shape.

The features common to both the storage embodiment, shown in FIGS. 1 through 6 and the display embodiment shown in FIGS. 7 through 11 have been described above, both in function and construction. The features specific to each embodiment will be described separately.

The storage embodiment of the invention is shown in FIGS. 2 through 6. It comprises the assembly of rack 20, rack ends 34 and "D" rod 46 with the array of tools 10 mounted therein as described above.

Additionally and specific to this embodiment are:

An enclosure or box 50, shown in FIGS. 2 through 5. The box 50 has end surfaces 52, bottom surface 54 and side surfaces 56, one of which is shown in FIG. 4. A cover or lid 58 is shown affixed to the box 50 in FIGS. 3 and 5.

Figure 6:
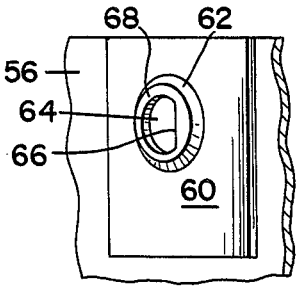
FIG. 6 is a perspective view of the mounting bracket feature attached to the side of the box, shown in break away.

Two brackets 60, one of which is shown mounted to box side surface 56 in FIGS. 4 and 6. Each bracket 60 has a circular boss 62 formed therein. A "D" hole 64, with straight edge 66, is centered and disposed in the boss faces 68. The brackets 60 are so positioned within the box 50 that the axis of the "D" holes 64 is parallel to both the end surfaces 52 and bottom surface 54.

The "D" rod 46, of the aforementioned assembly shown in FIG. 1, has a length corresponding closely to the distance between the two opposing box 50 side surfaces 56. With the opposite ends of the 46 "D" rod protruding approximately equally from the 34 rack ends, the assembly of FIG. 1 is assembled fixedly into the box 50 with the "D" rod 46 engaging the "D" holes 64.

In assembly the "D" rod 46 ends are forced down against the top sides of the bosses 62 exerting a camming force sufficient to elastically displace the box sides 56 a distance apart such that the boss faces 68 are a distance apart equal to the "D" rod 46 length. With the flat surface 48 of the rod 46 aligned with the flat edge 66 of the boss 62 "D" hole 64 and with the axis of "D" rod 46 in alignment with the axis of the "D" holes 64, the "D" rod 46 ends will enter the "D" holes 64 allowing the box sides 56 to return elastically to their normal position thus trapping the "D" rod 46 in a fixed non-rotative position relative to the box In this assembly the assembled rack 20, and rack ends 34 are free to pivot about the fixed "D" rod 46; from a down position as seen in FIGS. 3 and 5 with the axis of the tool retaining holes 30 parallel to the box bottom 54; to an up position as seen in FIGS. 2 and 4 with the axis of the holes 30 in a position parallel to the box sides 56 and end 52 and perpendicular to box bottom 54.

The lengths of the rack 20 top leg 22 and middle leg 24 are such as to contact the box bottom 54 at the point of rotation where the axis of the rack holes 30 and the rack spine 28, are parallel to the box bottom 54.

It is seen that in this position the minimum depth of the box is established, and that closure of box cover or lid 58 will cause its inside surface to bear against or close to the rack spine 28 top surface thus securing the rack 20 and tool array 10 against movement in the box 50. The lower leg 26 of rack 20 has been noted to be shorter than legs 22 and 24. This is to allow clearance with the bottom 54 of the box 50 during rotation of the rack 20. This is also essential to minimize the box 50 depth.

The display embodiment of the invention is shown in the plan view of FIG. 7. As with the foregoing embodiment, it comprises the assembly of rack 20, rack ends 34 and "D" rod 46 with the array of tools 10 mounted therein.

Figure 8:
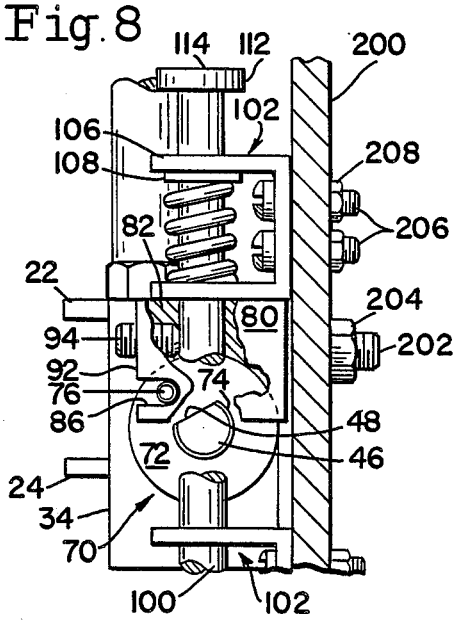
FIG. 8 is an end elevation view, in partial break away, of the assembly of FIG. 1 mounted to a display surface shown in section. The mechanism is shown in the tool restrain position.
Figure 9:
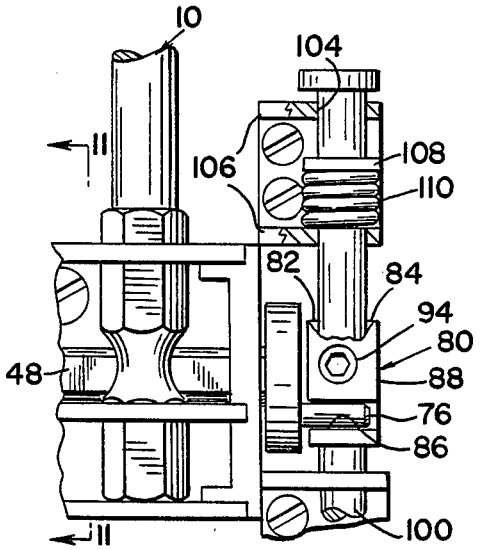
FIG. 9 is a plan view of the right end of FIG. 7 showing the mechanism in the tool release position.

Additionally and specific to this embodiment are:

A lever assembly 70 comprised of a circular disc 72, a "D" hole 74, centrally located at the axis of the disc 72, and a round pin 76, press fit into a hole radially removed from the disc 72 axis and beyond the diameter of the "D" hole 74. The "D" hole 74 is sized to be press fit, in assembly, to the end of the "D" rod 46. This assembly is shown in FIGS. 7, 8 and 9.

A cam block 80, rectangular in 3 axes, having a through hole 82 centered in and perpendicular to face 84: a notch or slot 86, of a width just greater than the diameter of pin 76 of the lever assembly 70, perpendicular to face 88: a threaded hole 90 perpendicular to top surface 92 and intersecting hole 82, threadingly receiving a set screw 94, to engage with and fasten block 80 to actuating rod 100 located within and through hole 82.

The actuating rod 100 is supported on either side of block 80 by rod guide brackets 102, of "U" channel cross section, having coaxial rod guide holes 104 in legs 106 to receive and support guide rod 100. Referring to FIGS. 7, 8 and 9, the uppermost guide bracket 102 has disposed within legs 106 a retaining ring 108, located within a groove in rod 100, assembled therein, which bears against spring 110 disposed around rod 100. At the upper end of rod 100 is located a circular shoulder 112 of a diameter larger than that of rod 100, either integral with or attached by threads or set screw to rod 100, which provides an actuating or push button surface 114.

The assembly comprising this embodiment is as follows:

Referring to FIGS. 7, 8 and 9, the assembly comprising the rack 20, the rack ends 34, the "D" rod 46, and the lever assembly 70 press fit thereto, is secured to display board 200 with screws 202 and nuts 204. Referring to FIGS. 7 and 8, the guide brackets 102 are mounted to board 200, above and below the assembly described above, with the axis of the holes 104 perpendicular to the axis of the "D" rod 46, being secured thereto with screws 206 and nuts 208.

Referring to the drawings, the rod 100, with retaining ring 108 and spring 110 assembled between the legs 106 of the upper bracket 102, engages and passes through the hole 82 of the cam block 80, which is secured thereto by set screw 94. The rod 100 is further supported and guided by the second guide bracket 102 located below, with the holes 104 of both brackets being coaxial. The relationship between the lever assembly 70 and the block 80, in assembly, is such that the slot 86 engages the pin 76.

The function of the assembly described above is the following:

Referring to FIGS. 7 and 8, with the spring 110 extended, the camming slot 86 locates the pin 76 in the lever assembly 70, in a position such that the flat surface 48 of the "D" rod 46 is at an angle to the axis of coaxial holes 30 in legs 22 and 24 of rack 20, and consequently to the longitudinal axis of the tools mounted therein as seen in FIG. 10. In this position the rearmost or lower groove radii of the tools are just completely engaged by the circumferential surface of "D" rod 46 thus restraining the tools against axial movement and removal.

Referring to FIG. 9 with the button 112 fully depressed and spring 110 fully compressed, the block 80 is moved to a position such that the slot 86 engaging the pin 76 moves the pin 76 rotationally around the "D" rod 46 axis, to an angular position in which the flat surface 48 becomes parallel to the axis of the holes 30 of the rack 20, and of the tools located therein. In this relationship, the most outer extreme surface or corner of the tool shank will clear the surface 48 of the "D" rod 46, allowing axial movement of and removal of the tool. This is best illustrated in FIG. 11. Upon removal of the depressing force on rod 100 button 112, the spring 110, acting against retaining ring 108 attached to rod 100, causes the rod, with block 80 attached, to move upward until the retaining ring 108 contacts the upper leg of the bracket 102. In this position, the slot 86 in block 80 has returned the pin 76 to its original position causing the "D" rod 46 to lock any remaining tools in the array 10 in place.

The embodiment above and the drawings referred to describe a display of a discrete number of tools, in this case five, mounted in a single rack assembly, with a mechanism for alternately locking and releasing the tools. It can readily be seen that the length of the rack assembly can be altered to accommodate a greater or lesser number of tools.

It can also be seen that additional rack assemblies, with differing arrays of tools, can be mounted below and parallel to that shown in FIG. 7. This is accomplished by providing a lever assembly 70 attached to each "D" rod 46 of the additional rack assemblies, with the pin 76 engaging the camming slot 86 of additional blocks 80 mounted and attached to the actuating rod 100 which is lengthened to accommodate the desired number of arrays to be displayed. The relationship between the additional lever assemblies 70, blocks 80, camming slots 86 and "D" rods 46, in assembly and function, is the same as described above for the single array shown in FIG. 7. It is noted, that for this multiple array application, only one actuating rod 100, one button 112, one spring 110, and one retaining ring 108, is required.

It is thus seen that a highly visible display is achieved, with the tools displayed therein normally locked in place against non-discretionary removal; and by the actuation of the button, discretionary removal of one or more of the tools can be achieved.

While the method of rotating the "D" rods 46 into the locking and unlocking positions as described above have been made clear in the embodiment as described and illustrated; it will be immediately obvious to those skilled in the art of basic mechanisms that this rotational effect can be accomplished in several ways.

In both the storage and display embodiments described above, the terms storage and display, as noted previously, have been used to delineate functional differences of the embodiments described. It is noted here, that depending upon the application of the principles described, the terms might be used interchangeably. Thus if the lid on the box 50 of the first embodiment described were of a clear material, such as transparent plastic, or were left open, the tools therein would be both stored and displayed. Alternately, in the second embodiment described, the tools, mounted on a panel or board, could be considered stored for ready access by a user in a shop or working area environment offering protection against unauthorized use by securing the releasing mechanism against actuation with a locking device.

In both the storage and display embodiments described herein, it is seen that the relative angular position of the "D" rods 46 to the axes of the holes 30 in the racks 20, restraining the tools therein achieves the locking and unlocking action common and intrinsic to both; and while the principles of the invention have been made clear in the illustrative embodiments, there will be obvious, to those skilled in the art, many modifications of structure, arrangement, proportions, the elements, material, and components used in the practice of the invention, and otherwise, which are particularly adapted for specific environments and operative requirements without departing from those principles. The appended claims are intended to cover and embrace any and all such modifications, within the limits only of the true spirit and scope of the invention.

This specification and the appended claims have been prepared in accordance with the applicable patent laws and the rules promulgated under the authority thereof.

What is claimed is:

1. An apparatus for discretionarily securing and releasing tools having non-circular shanks and having a groove extending circumferentially about the shank with a flat center portion and a radiused portion on the groove comprising in combination:

a rack means including an elongated upper shelf with holes aligned in the longitudinal direction, an elongated middle shelf with an identical row of holes so disposed as to be in axial alignment with the holes in the upper shelf, an elongated lower shelf parallel to the upper and middle shelves, the surface of which is uninterrupted, rack ends parallel to each other and perpendicular to the shelves in the longitudinal direction, with a hole in each in axial alignment, one to the other, the axis of which is perpendicular to the rack ends, and a rod means having a D shape in cross section and a diameter approximately twice the radius of the tool shank groove, disposed in the rack end holes such that rotation of the rod is permitted about their co-axes, the structural and functional relationship between the rack means, the rod means assembled therein and the tools is such that the holes in the upper and middle shelves are of a size to accept the tools shanks, holding the tools perpendicular to the shelves, the axial movement of the tools is restrained against further axial movement in the insertion direction by the lower shelf, and in a fixed relationship to the upper and lower shelves, the middle shelf being located to engage the non-circular shank below the groove of the tool when the tool bears against the lower shelf and the upper shelf being located above the groove, the axial location of the rod means, and the rack end holes, relative to the axis of the tool retaining holes in the upper and middle shelves and the tool arresting lower shelf is approximately coaxial with the axis of the lower tool shank radius, with the tool in the arrested position, the chord length of the flat surface of the rod means being such as to allow clearance with the outermost circumferential extremities of the non-circular tool shank when the flat surface of the rod means is rotated to a position parallel to the axis of the tool retaining holes in the upper and middle shelves of the rack means permitting removal and insertion of the tool shank and conversely prohibiting extraction or insertion of the tool shank when the rod means is rotated such that the flat surface of the rod means is at an angle to the tool axis and its circumferential surface is in a position to coincide with the radius portion of the groove in the tool bit shank.

2. The apparatus of claim 1, in which the rod means having a D shape cross section, is constrained against rotation relative to displaced fixed surfaces perpendicular to the rod means, which surfaces have disposed therein D shaped holes, these D holes being similar in proportion and size to the D cross section of the rod means, each end of which is disposed within said holes, the relative position of the flat portion of the rod means to the axis of the holes in the upper and middle shelves, which restrain the tool shanks from radial movement, being changed by the rotation of the rack means about the fixed rod means, thus providing an interference against tool removal and insertion when the flat surface is at an angle to the axis of the tools and permitting removal and insertion of the tools when the flat surface of the rod means is parallel to said axis.

3. The apparatus of claim 2 in which the fixed parallel surfaces are the sides of a box for storing the tool bits therein, the rack means and tools restrained in the shelf holes therein, when rotated about the rod means in a position wherein the tools are parallel to the bottom of the box and within the confines thereof, are in a position, relative to the flat surface of the rod means fixed in relation to the side and bottom surfaces of the box, to be restrained against axial movement, and when rotated to an angle approximating a perpendicular to the bottom of and out of the confines of the box, reach a position such that tools can be removed and inserted.

4. The apparatus of claim 2 in which the fixed surfaces are attached to the inner surfaces of the sides of a box storing the tool bits therein, the rack means and tools restrained in the shelf holes therein, when rotated about the rod means in a position wherein the tools are parallel to the bottom of the box and within the confines thereof, are in a position, relative to the flat surface of the rod means fixed in relation to the side and bottom surfaces of the box, to be restrained against axial movement, and when rotated to an angle approximating a perpendicular to the bottom of and out of the confines of the box, reach a position such that tools can be removed and inserted.

5. The apparatus of claim 1 in which the rack means is secured to a flat surface on which tools are to be stored or displayed, the shelves of the rack means extending out and away from and perpendicular to said surface, the rod means having a D shape cross section is disposed in and free to rotate in the rack means end holes, the position of the rod means flat surface thus being angularly variable relative to the axis of the tool restraining holes in the rack means, where in one angular position tools can be inserted and removed from the rack means and in another position the tools can be locked against insertion and removal.

6. The apparatus of claim 5 in which the means of rotating the rod means is a lever attached to one end of said rod means.

7. The apparatus of claim 6 in which the lever is biased to one position by the action of a spring.

8. The apparatus of claim 7 in which the spring acts against a shoulder on a rod having a camming surface attached thereto which camming surface acts against a projection of the lever with relative motion between the two causing the rod means to which the lever is attached to rotate.

* * * * *